US006148745A

United States Patent [19]

Wulfert et al.

[11] Patent Number: 6,148,745

[45] Date of Patent: Nov. 21, 2000

[54] METHOD FOR THE COMBUSTION OF VANADIUM-CONTAINING FUELS

[75] Inventors: Holger Wulfert, Duesseldorf; Andre Michael Baetz, Essen; Klaus Goerner, Ratingen; Friedrich Schmaus, Balve-Garbeck, all of Germany

[73] Assignees: Loesche GmbH, Duesseldorf; Walter Brinkmann GmbH, Werdohl, both of Germany

[21] Appl. No.: 09/251,447

[22] Filed: Feb. 17, 1999

[30] Foreign Application Priority Data

Feb. 18, 1998 [DE] Germany ..... 198 06 823

[51] Int. Cl.[7] ..... F23D 1/00

[52] U.S. Cl. ..... 110/347; 110/264

[58] Field of Search ..... 110/260, 261, 110/262, 263, 264, 265, 266, 347, 346, 234

[56] References Cited

U.S. PATENT DOCUMENTS

| | | | |
|---|---|---|---|
| 2,855,873 | 10/1958 | Von Swietochowski | 110/266 |
| 4,408,548 | 10/1983 | Schmalfeld et al. | 110/263 X |
| 4,550,563 | 11/1985 | Marchand | 110/264 X |
| 5,000,098 | 3/1991 | Ikeda et al. | 110/264 X |

FOREIGN PATENT DOCUMENTS

| | | | |
|---|---|---|---|
| 0 006 423 | 1/1980 | European Pat. Off. . | |
| 28 04 513 | 9/1978 | Germany | 110/260 |
| 41 14 171 | 11/1992 | Germany . | |

OTHER PUBLICATIONS

Rotationsfeuerungssystem Einsatzbereit für jeden Brennstoff, 6141 Chemie Tecknik, 24 (1995) Jun., No. 6, Heidelberg, DE.

*Primary Examiner*—Ira S. Lazarus
*Assistant Examiner*—Ljiljana V. Ciric
*Attorney, Agent, or Firm*—Jacobson, Price, Holman & Stern, PLLC

[57] ABSTRACT

Method for the combustion of vanadium-containing fuels that makes use of the extremely high reactivity of the vanadium-containing fuels for combustion in a dust furnace. To avoid disadvantageous slag caking in a combustion area and in particular in the vicinity of the feed nozzles, e.g. for the pulverized fuel-air mixture and for combustion air, in a dust furnace, a top burner is placed in a roof of a combustion area and at least open dust nozzel is so positioned for the supply of the pulverized fuel-air mixture that a return flow of liquid slag particles to the top burner is prevented.

18 Claims, 5 Drawing Sheets

III
16
IV
IV
III
6.2
6
38
6.1
27
27
6.3
38
32
21

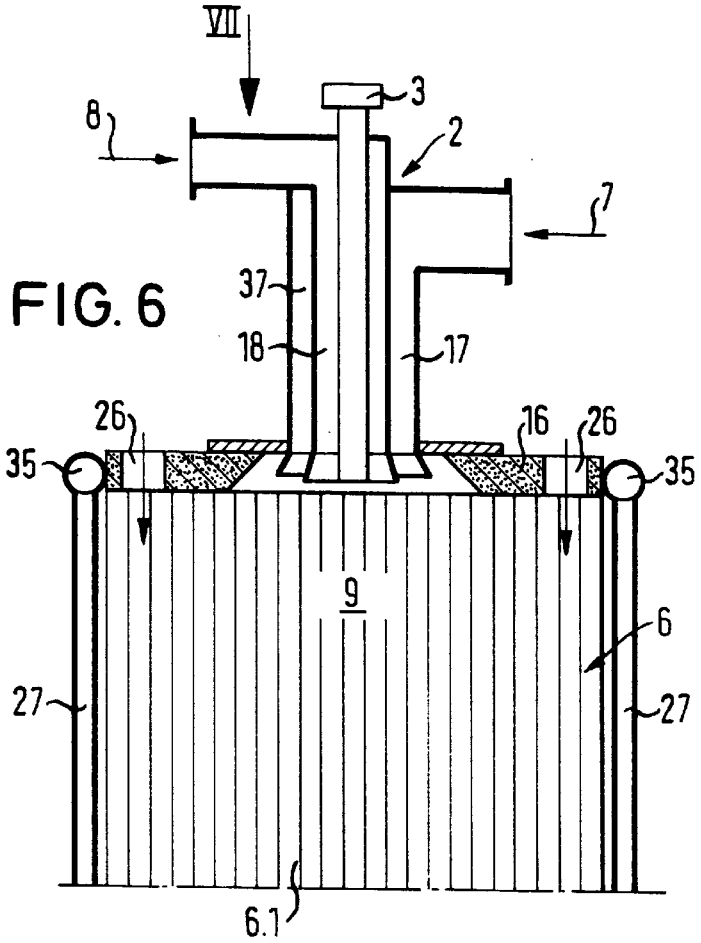
FIG. 6
FIG. 7
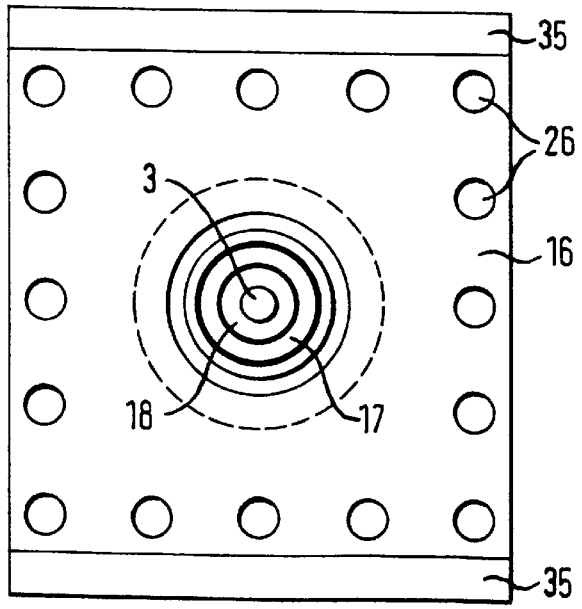

METHOD FOR THE COMBUSTION OF VANADIUM-CONTAINING FUELS

BACKGROUND OF THE INVENTION

The invention relates to an apparatus for the combustion of vanadium-containing fuels and a method for the combustion of vanadium-containing fuels.

Vanadium-containing fuels are obtained as residues during pretroleum refining. These residues are generally burned in spiral flow or rotary heaters and vanadium and compounds thereof, together with other recyclable constituents of the residues are obtained in slag and ash form, which can advantageously undergo further treatment. Simultaneously the heat released during combustion can be recovered.

A spiral flow heater for the heat treatment of carbon-containing residues from petroleum refining is known from DE 41 14 171 C2. Carbon-containing materials with non-flammable constituents and pollutants are supplied in a predetermined particle size tangentially in a delivery air flow to a combustion chamber and burned at temperatures above the slag melting point. The combustion air is tangentially blown in such a way that a direct contact and sticking of slag to an inner lining of the combustion chamber are avoided. As a result of cooling, the slag is discharged in solid form.

It has been found that during the combustion of vanadium-containing carbon black dust in a spiral flow furnace spontaneously liquid slag is produced at the common burner chamber temperatures.

The spontaneous slag sticking is particularly disadvantageous in the vicinity of the supply nozzles for the pulverized fuel-air mixture and the air nozzles for the combustion air. Even after relatively short operating periods the nozzles suffer slag penetration leading to a restriction and disturbance to heater operation.

SUMMARY OF THE INVENTION

The object of the invention is to provide an apparatus and a method for the combustion of vanadium-containing fuels, particularly from petroleum refining, which permit a substantially troublefree and particularly efficient recovery of vanadium and hot gas production without any slag penetration of the feed nozzles.

According to the invention, this object is achieved by an apparatus having a combustion area, a start burner and feeds for a pulverized fuel-air mixture and combustion air, as well as with a flue gas outlet and slag discharge means, in which a top burner is located above the combustion area and is formed in a top cover as a top cover burner. In the cover of the top burner are located at least the start burner and the supply for the pulverized fuel-air mixture with at least one dust nozzle. The at least one dust nozzle is positioned in such a way that the pulverized fuel-air mixture is introduced into the combustion area on a secant to the cross-sectional surface thereof and under an angle between 35° and 65° to the longitudinal axis of the combustion area or alternatively coaxially to the start burner.

From the method standpoint, the object is achieved in that the vanadium-containing residues from petroleum refining or also other vanadium-containing fuels are fed to a top burner, which is located in a top cover of a combustion area. According to the invention, the pulverized fuel-air mixture is supplied following a secant to the cross-sectional surface of the combustion area and under an angle between 35° and 65° to the longitudinal axis thereof or, in an alternative construction, coaxially to a start burner located in the top cover of the combustion area and is burned with short burn-out times and an adjustable ignition front.

The method and apparatus according to the invention are based on the surprisingly high reactivity of the vanadium-containing residues and an extremely rapid ignition and short burn-out times of the vanadium-containing pulverized fuel. Tests have shown that the high reacitivity and high combusiton speed and the formation of a highly corrosive, liquid slag can be attributed to metallic constituents of the fuel, which oxidize. It is assumed that the metallic constituents have a catalytic action on the combustion and bring about the formation of the spontaneous, liquid slag. During combustion vanadium is converted into vanadium pentoxide, which has a melting point of 672° C. In mixtures with further metal oxides, e.g. nickel and iron oxides, there is a slag melting point between 700 and 850° C., which is extremely low compared with other slags. Therefore, the possible combustion temperatures are always above this melting point, so that basically, liquid slag is unavoidable. In order to ensure that no function-preventing sticking occurs in a combustion chamber and particularly in the vicinity of the feed nozzles for the pulverized fuelair mixture, for combustion air or other media, according to the invention a top cover or roof burner is provided and the feed nozzles are oriented in such a way that a return flow of liquid slag is prevented. With a defined flow guidance and nozzle shaping a substoichiometric combustion zone is obtained directly after the pulverized fuel has passed out of the dust nozzles, so that spontaneous slag formation in the vicinity of the dust nozzles is prevented. Moreover, the defined flow guidance makes it possible to ensure an adequate, predeterminable spacing between the nozzles and the formation of liquid slags.

In a first apparatus embodiment the dust burner is constituted by a top burner in a top cover with a frustum-like cover wall. Eccentrically within the top cover are provided a predeterminable number of dust nozzles, which are constructed in lance-like manner. By means of said dust nozzles the pulverized fuel is blown in on secants under a predeterminable angle to the longitudinal axis of the refractory lined combustion chamber. Directly after passing out of the dust nozzles no secondary combustion air is supplied, so that there are near-stoichiometric to pronounced substoichiometric ratios in said first combustion zone, e.g. with $\lambda$=0.2 to 1.0.

The arrangement of the dust nozzles or lances in the cover of the combustion chamber prevents a clogging of the nozzles with slag in this embodiment. It is advantageous that the dust exit velocity can be modified for changing the ignition front of the dust in a predeterminable spacing with respect to the nozzle. Appropriately the velocities of the pulverized fuel supplied are between 10 and 45 m/sec, preferably 20 m/sec.

Tests have shown that the reactivity of the vanadium-containing fuel is decisively dependent on the vanadium and oxygen content of the residues. With a lower vanadium and oxygen content it is advantageous to compensate the slower reaction speed by a better mixing of the pulverized fuel and the air. In respect of the apparatus, such a mixing can be implemented by spin means or swirling devices in the preferably annular combustion air duct of the top or roof burner.

For the supply of secondary air to the combustion chamber there can be provided a stepped air supply by means of several, preferably two air nozzles. Specially shaped flaps in the air nozzles make it possible to change the exit velocity of the combustion air for different mass flows. Thus, the ash/slag ratio can be varied. In addition, the combustion air exit velocity effects the burn-out, so that the latter can also be controlled via the exit velocity of the combustion air.

In a second apparatus embodiment a top burner is placed in a roof or cover of a combustion area which, as in the first apparatus and method embodiment, is formed in a refractory lined combustion chamber. Thus, the top burner is located in a cover of the refractory lined combustion chamber and can also be referred to as a cover or head burner.

It is advantageous that the refractory lining of the preferably cylindrical combustion chamber can serve as an ignition aid and a double jacket for preheating the combustion air. Combuation is largely ended within a relatively small combustion chamber volume. A waste heat boiler, which follows the refractory lined combustion chamber, can have a smaller volume than when no lined combustion chamber is used. Obviously cost advantages result from this solution.

It is also appropriate for the top burner to have a start burner, which is preferably operated with gas or oil and as a dust nozzle is provided an annular clearance for the vanadium-containing pulverized fuel-air mixture in concentric manner around the start burner.

Combustion with a top burner in a refractory lined combustion chamber is carried out at temperatures in the range 1100 to 1650° C., preferably at 1200° C. It has been found that the vanadium-containing residues ignite at a safe distance upstream of the top burner and, aided by the refractory walls of the brick lined combustion chamber, a volume of maximum combustion intensity is formed. This leads to an almost complete and rapid burning of the fuel, which in respect of the apparatus is advantageous for the after-reaction volume of a first flue pass of a downstream waste heat boiler. The flue gas formed during combustion, together with the liquid slag pass into the waste heat boiler, where the slag is cooled to temperatures below the solidification point of approximately 800 to 900° C. and are advantageously largely discharged as very fine dust together with the flue gas.

For the case a solid slag is obtained, it is appropriate to provide the waste heat boiler and in particular the first flue pass with a slag discharge means, so that slag droplets deposited on the refractory walls of the combustion chamber and which drop into the waste heat boiler can be discharged.

In a third apparatus embodiment a combustion area with up-stream top burner is placed in a waste heat boiler. The top burner is incorporated into the roof of the first flue pass of the waste heat boiler. There is no need to have an ignition aid in this apparatus and method embodiment. Thus, in respect of the method, the top burner is operated for obtaining higher combustion temperatures with a lower air excess. The air excess is in the range $\lambda$=1.05 to 1.4, preferably at $\lambda$=1.1. If combustion takes place at temperatures of 1600 to 1800° C., a good burn-out can be obtained.

If no stable flame forms, it is advantageous to use the centrally positioned start burner with a lower load as a supporting burner.

As a result of the high combustion temperature, liquid slag is also produced in this apparatus embodiment. The slag droplets are finely dispersed in the flue gas and cool in the flue flow through a radiant heat exchange with the boundary walls of the waste heat boiler. Thus, the vanadium-containing fuel is discharged almost completely as pulverulent slag. There is consequently no need for a removal of solidified slag, which is generally complicated.

Appropriately recirculated flue gas is vertically injected by means of nozzles into the boiler top cover and concentrically to the top burner or head burner. Slag droplets on the walls of the waste heat boiler are repelled by the injected, recirculated flue gas and caking on the waste heat boiler walls is prevented. Prior to entering pipe bundles, which are in particular located in a third flue pass of the waste heat boiler, the flue gas and the slag constituents contained therein are cooled to below 500° C., to prevent corrosion, particularly due to vanadium oxides, especially vanadium pentoxide.

According to an advantageous development use is made of a combustion chamber, which at least in the particularly wear-intensive areas, has coolable walls or wall sections as a so-called "cooling field". The cooling field can be formed by water-containing pipes in a refractory lining of the combustion chamber. For example, pinned pipe coils can be laid horizontally and enveloped with a refractory vibration material. The intense, water-side cooling ensures a cooling of the combustion chamber-side surface to a temperature below the solidification point of the downwardly flowing slag and the formation of a corrosion-protecting slag shield.

It is appropriate to only construct the particularly wear-intensive wall areas as "cooling fields" in order not to disadvantageously influence the heat balance of the combustion chamber through heat losses via the walls. Preferably, no more than 15% of the entire surface of the combustion chamber should be constructed as a "cooling field".

According to a further apparatus and method embodiments, the distance of the ignition front from the pulverized fuel-air mixture supply is regulated by an enveloping of the dust jet. The enveloping can be constituted by an inert gas, e.g. nitrogen. As a result of the inertizing envelope around the dust jet it is possible to prevent premature ignition in the vicinity of the dust nozzle and this can be regulated by admixing the combustion or secondary air.

It is also advantageous that slag caking is further prevented through the exit velocity of the enveloping inert gas.

BRIEF DESCRIPTION OF THE DRAWINGS

The invention is described in greater detail hereinafter relative to the attached drawings, wherein show in highly diagrammatical manner:

FIG. 6 a third embodiment with a top burner in the top cover of a waste heat boiler without brick lining;

FIG. 7 a plan view along arrow VII in FIG. 6;

DESCRIPTION OF THE PREFERRED EMBODIMENTS

Figure 1:
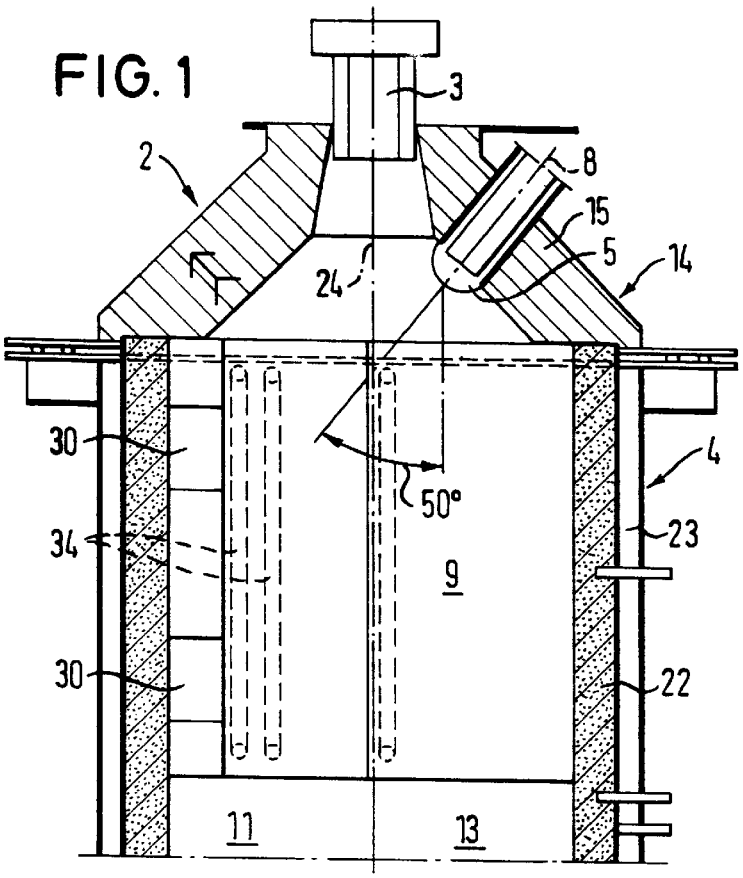
FIG. 1 a vertical section through a first embodiment of a combustion chamber and a top burner with frustum-like cover and dust lances along line I—I in FIG. 2.

A first embodiment of the apparatus for the combustion of vanadium-containing fuels according to FIG. 1 has a combustion chamber 4 with a frustum-like cover or roof 14, a start burner 3, a dust lance 5 as a dust nozzle which is placed in a sloping roof wall 15. In the lower area a flue gas exit 13 is provided. The combustion chamber 4 has a refractory lining 22 and a double jacket 23, in which combustion air is preheated. The brick lined double jacket 23 serves as an ignition aid.

Figure 2:
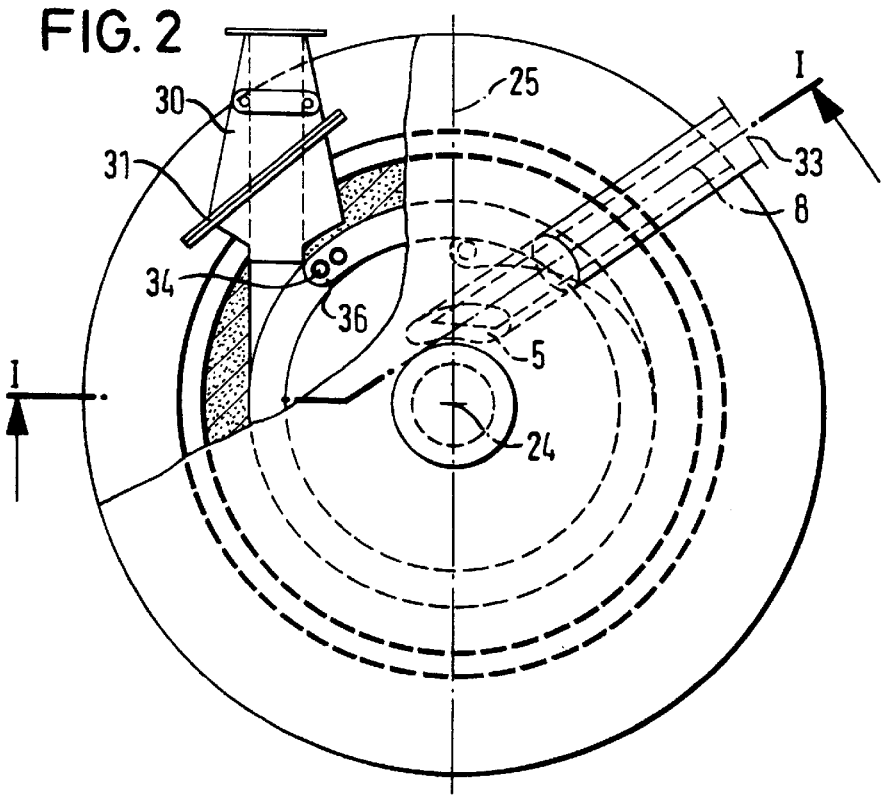
FIG. 2 a part sectional plan view of the combustion chamber of FIG. 1.

FIGS. 1 and 2 make it clear that the dust lance 5, as a result of its arrangement, permits a blowing in of vanadium-containing pulverized fuel-air mixture on a secant 33, which is formed at an angle of approximately 50° to a longitudinal axis 24. The combustion chamber 4 contains two air nozzles 30, through which secondary air is tangentially supplied. It can be gathered from the cross-sectional representation of FIG. 2 that upstream of the two superimposed air nozzles 30, deflector projections 36 are formed, in whose vicinity there are water pipes 34. In the vicinity of the air nozzles 30 are provided flaps 31 for influencing the air supply.

Figure 5:
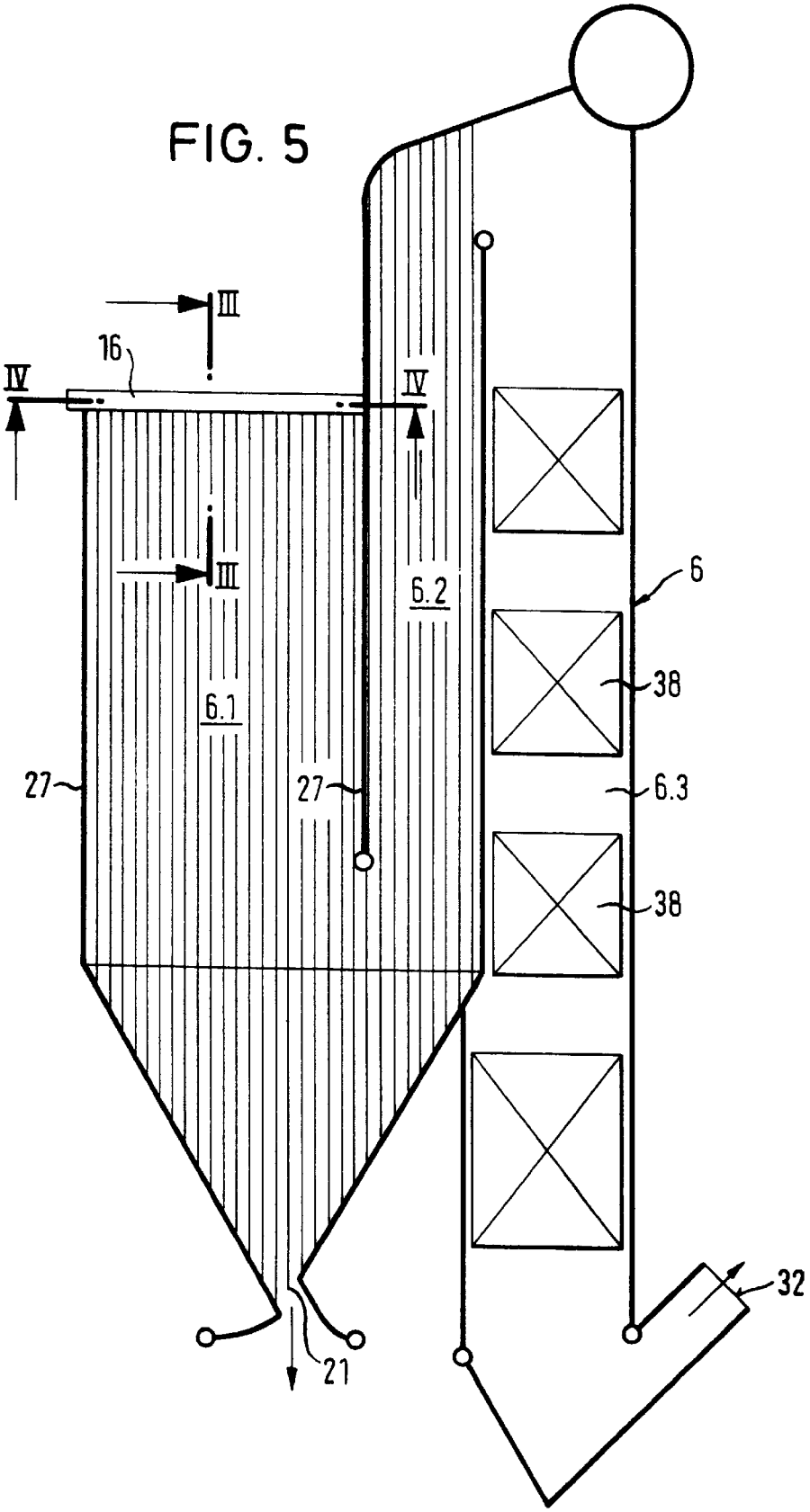
FIG. 5 a diagrammatic representation of a waste heat boiler.

The slag and flue gases formed in a combustion area 9 of the combustion chamber 4 are supplied by means of the flue gas exit 13 to a following or downstream waste heat boiler 6 (cf. FIG. 5).

Figure 3:
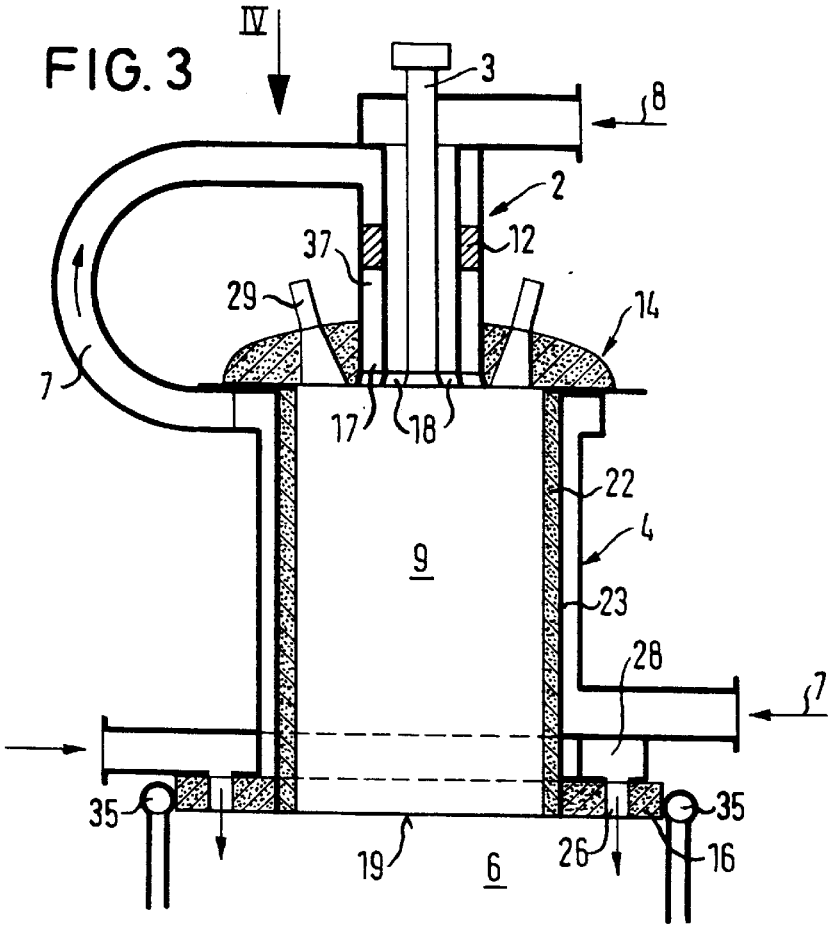
FIG. 3 a vertical section through a second embodiment of an apparatus according to the invention with a combustion chamber, a top burner and a down-stream waste heat boiler (shown in detail form)
Figure 4:
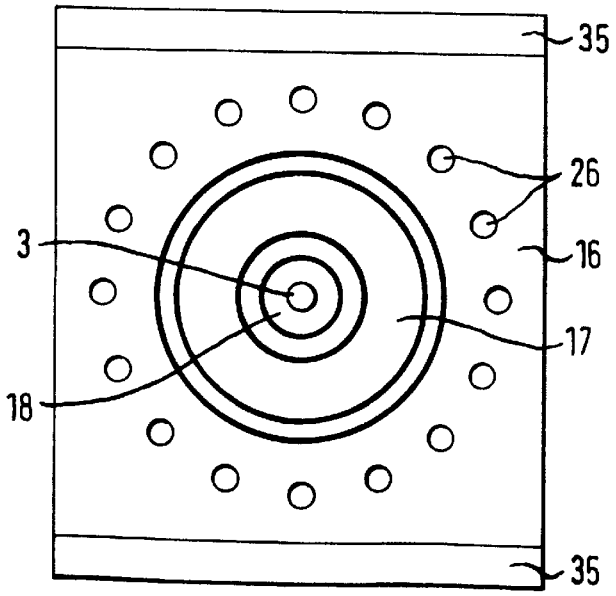
FIG. 4 a plan view along arrow IV in FIG. 3.

FIGS. 3 and 4 show a second embodiment of an apparatus with a refractory lined combustion chamber 4 with a combustion area 9 and a roof 14 with a top burner 2 as a dust burner.

In the vicinity of its exit opening 19 for slag droplets and flue gas, the combustion chamber 4 is placed on a cover or roof 16 of a waste heat boiler 6. The top burner 2 has a centrally positioned start burner 3 and an annular nozzle 17 for combustion air 7 and an inner annular nozzle 18, the nozzle 18 being suplied with the pulverized fuel-air mixture as a protective envelope of nitrogen coaxilly to the pulverized fuel-air mixture by means of a supply 8. In the outer, annular nozzle 17 for the combustion air 7 preheated in a double jacket 23 is provided a device 12, which can be adjusted to bring about a greater or lesser mixing and swirling between the air and fuel, as a function of the vanadium and oxygen content of the fuel. The roof 14 of the combustion chamber 4 is flat in this embodiment and has flame detectors 29. The top burner 2 according to FIG. 3 leads to an extremely rapid ignition of the pulverized fuel air mixture and to short burn-out times. The combustion is largely terminated within the combustion area 9, which has a relatively small volume, and also the after-reaction area of the waste heat boiler 6 can have a relatively small volume.

FIG. 5 shows a waste heat boiler 6 with a first, second and a third flue pass 6.1, 6.2 and 6.3. The roof 16 of the waste heat boiler 6 is only intimated in FIG. 5. Into the first flue pass 6.1 of the waste heat boiler 6 passes a mixture of flue gas and slag droplets by means of the exit opening 19 (cf. FIG. 3). In order to prevent deposition of the slag on the boundary walls 27 of the waste heat boiler 6 leading to solid caking, by means of nozzles 26, which according to FIG. 3 are formed concentrically about the exit opening 19 in the cover 16 of the waste heat boiler 6, recirculated flue gas is blown in. The recirculated flue gas protects the walls of the waste heat boiler 6 against slag deposits. The circular, concentric arrangement of the nozzles 26 can be gathered from FIG. 4. In the lower area of the first flue pass 6.1 is provided a discharge opening 21 for ash removal or slag discharge.

The waste heat boiler 6 has pipes in the first and second flue passes 6.1 and 6.2 and operates according to the low pressure evaporation system. The third flue pass 6.3 contains pipe bundles 38 and, on the bottom, a discharge opening 32 for flue gas containing slag ash.

FIGS. 6 and 7 show a third apparatus embodiment, in which a top or roof burner 2 is located in the roof 16 of a waste heat boiler 6. The roof burner 2 is positioned centrally in the roof 16 above the first flue pass 6.1 of the waste heat boiler. The roof burner 2 has a centrally positioned start burner 3. The pulverized fuel-air mixture is blown by means of the supply 8 and an annular nozzle 18 into a combustion area 9 in the first flue pass 6.1. With the exception of the supply of preheated combustion air 7, the roof burner 2 corresponds to that according to FIG. 3. However, the roof burner 2 is operated with a smaller air excess, in order to obtain higher combustion temperatures of approximately 1600 to 1800° C. and also a good burn-out.

During combustion in the combustion area 9 of the first flue pass 6.1 of the waste heat boiler 6 flue gas is formed and, as a result of the high combustion temperatures, initially liquid slag. The latter is in the form of finely dispersed droplets in the flue gas and cools by radiant heat exchange with the walls or boundary walls 27 of the waste heat boiler 6. Thus, the slag is discharged in dust-like manner with the flue gas. There is no need for a solid slag removal. The boundary walls 27 are in principle formed by through-flow pipes, which are combined in corresponding headers 35.

To prevent caking or sticking, recirculated flue gas is blown by means of an annular duct 28 (FIG. 3) and nozzles 26 located in the boiler roof 16. Consequently, the slag droplets are repelled from the walls of the waste heat boiler 6, where the flue gas and slag droplets are cooled to <500° C.

As in the third method and apparatus embodiment of FIGS. 6 and 7 no refractory lined combustion chamber is required, considerable advantages arise. As a result of the limited storage mass of the furnace in the first flue pass 6.1 a rapid starting and stopping is possible. No long heating-up time is required. The apparatus can be rendered inoperative without any long subsequent cooling time. In the case of emergency disconnections there is no need to fear thermal damage as a result of a lack of cooling. The burner load can be very rapidly changed. Burner setting tests can be rapidly performed. Steady state times are short and permit a rapid termination of the setting work. The overall structure of the apparatus is considerably simplified, which reduces costs and increases the function value. There are no surfaces where liquid slag can be deposited and run down.

Figure 8:
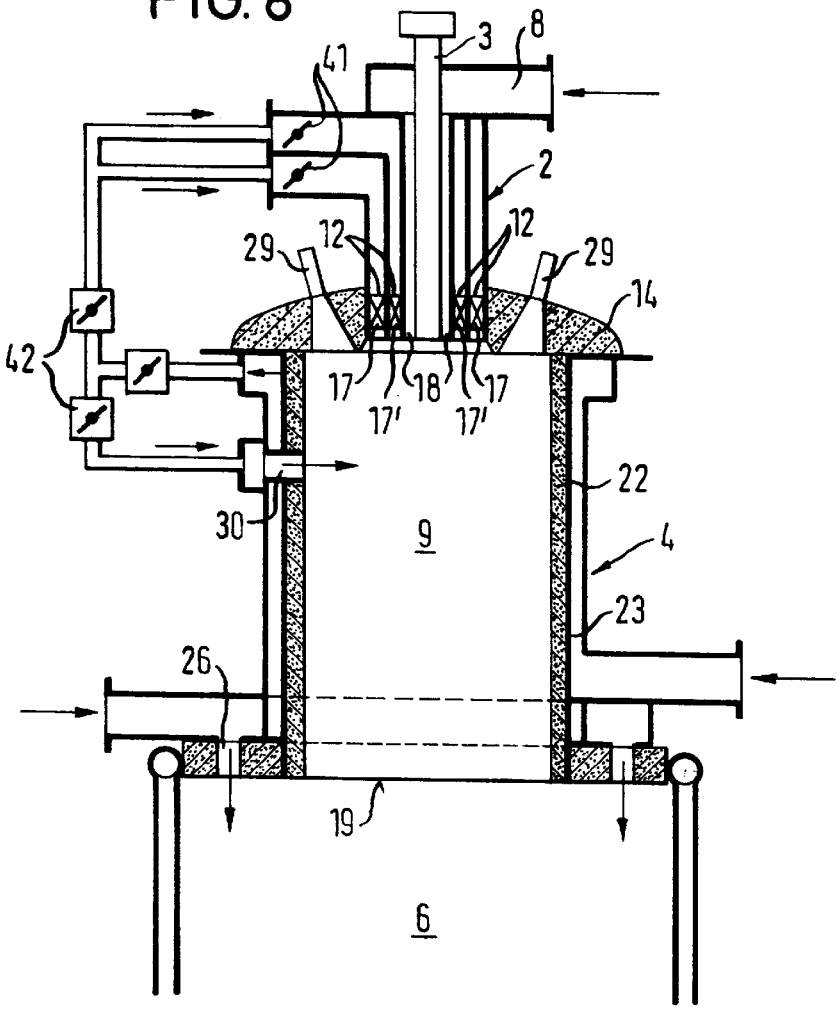
FIG. 8 a vertical section through a modification of an apparatus according to FIG. 3.

FIG. 8 shows in a vertical section a modification of the combustion chamber 4 ad roof burner 2 according to FIG. 3. Coinciding elements and arrangements are consequently given the same reference numerals as in FIG. 3. The modification essentially relates to a double annular nozzle 17, 17' which is substantially coaxially arranged around the start burner 3 and the ring nozzle 18 supplying the pulverized fuel-air mixture. In the annular nozzles 17, 17' for the preheated combustion air are provided swirling or spin means 12 and in the upper area controllable flaps 41. The combustion air preheated in the double jacket 23 can, in this embodiment, be passed by means of correspondingly regulatable flaps 42 wholly or partly for the purpose of feeding the annular nozzles 17, 17'. By means of the corresponding flaps 42 it is also possible to blow the preheated combustion air by means of an air nozzle 30, at a distance from the top burner roughly tangentially into the combustion area 9.

Figure 9:
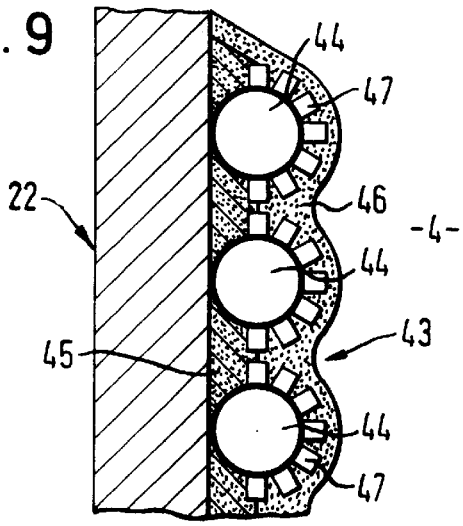
FIG. 9 a horizontal section through a combustion chamber wall in the vicinity of a "cooling field".

FIG. 9 shows a horizontal section through the wall 22 of a combustion chamber 4, which can e.g. be constructed according to FIG. 1 or according to FIGS. 3 or 8. The wall 22 in FIG. 9 is constructed as a coolable wall section 43 or as a so-called "cooling field" in a particularly wear-intensive zone of the combustion chamber 4. The coolable wall section 43 is provided with pipes 44, which are laid as cooling water-containing pipe coils, and at least on the combustion area-side is coated with refractory material 45.

The pipes 44 have pins 47, which project radially and are e.g. welded. These pins 7 aid the solidification of the molten slag and the formation of a protective layer 46 of vanadium pentoxide-containing slag.

What is claimed is:

1. Method for combustion of vanadium-containing fuels from petroleum refining, comprising the steps of:

providing a combustion apparatus with a combustion area, a roof over the combustion area, a start burner arranged in the roof, a supply for a pulverized fuel-air mixture provided in the roof, a dust nozzle provided in the roof, and a top burner positioned above the combustion area, the top burner being constructed as a roof burner in the roof;

supplying the vanadium-containing fuels to the top burner as the pulverized fuel-air mixture and to the combustion area by one of (a) on a secant to a cross-sectional surface of the combustion area and under an angle between 35 and 65° to a longitudinal axis of the combustion area and (b) coaxially to the start burner;

burning the pulverized fuel-air mixture in the combustion area with short burn-out times and with an adjustable ignition front to produce a flue gas and slag; and discharging the flue gas and slag from the combustion area.

2. Method according to claim 1, wherein no combustion air is supplied to the pulverized fuel-air mixture, immediately after exiting in a vicinity of the top burner, so that in this area there is a combustion zone with near-stoichiometric to substoichiometric ratios of $\lambda$ approximately equal to 0.2 to 1.0.

3. Method according to claim 1, wherein combustion air is supplied to the combustion area in one of a tangentially and an axially displaced manner in a vicinity of a wall and coaxially to the pulverized fuel air mixture in a vicinity of the top burner.

4. Method according to claim 3, wherein the pulverized fuel-air mixture is blown into and burned in the combustion area of a combustion chamber.

5. Method according to claim 4, wherein the combustion air is preheated in a double jacket of the combustion chamber.

6. Method according to claim 1, wherein the pulverized fuel-air mixture is burned at temperatures between 1100 and 2000° C. with a high ignition performance and an ignition front in a range approximately equal to 10 to 600 mm upstream of one of the top burner and a dust nozzle of the pulverized fuel-air mixture.

7. Method according to claim 1, wherein combustion takes place in a combustion chamber with a refractory lining at temperatures approximately equal to 1200° C., wherein a mixture of flue gas and one of liquid slag and ash particles is formed, wherein the mixture, following a short residence time and substantially in a burned-out manner, is introduced from the combustion chamber into a waste heat boiler, wherein recirculated flue gas is blown into the waste heat boiler in a first flue pass and guided along boundary walls, and wherein the slag particles are largely discharged as dust from the first flue pass.

8. Method according to claim 1, wherein the top burner is operated for obtaining higher combustion temperatures with a smaller air excess which is in the range $\lambda$=1.05 to 1.4, wherein combustion takes place at temperatures of approximately 1600 to 1800° C. and with an almost complete burn-out, and wherein flue gas and liquid slag particles are formed which are cooled to below 900° C. and discharged in dust form via a discharge opening of a third flue pass of a waste heat boiler.

9. Method according to claim 1, wherein the adjustable ignition front of the pulverized fuel-air mixture is adjusted by modification of pulverized fuel discharge speed.

10. Method according to claim 9, wherein the speed at which the pulverized fuel-air mixture passes out of the top burner is set at 10 to 45 m/s.

11. Method according to claim 1, wherein combustion, which is accelerated in a case of a higher vanadium percentage in the pulverized fuel-air mixture, is regulated by air supply.

12. Method according to claim 11, wherein the pulverized fuel-air mixture is more intensively mixed in a case of a lower vanadium content of the pulverized fuel-air mixture.

13. Method according to claim 11, wherein exhaust velocity of the combustion air is varied in a case of a constant volume flow of the vanadium containing pulverized fuel-air mixture.

14. Method according to claim 13, wherein the exhaust velocity of the combustion air is adapted to different loading conditions and burn-out as well as slag/ash ratio.

15. Method according to claim 1, wherein the pulverized fuel-air mixture is introduced into and burned in a combustion area with a refractory lining and at least one coolable wall portion, and wherein a combustion area-side surface of the coolable wall portion is cooled to below a solidification point of the slag and a vanadium-containing slag protective layer is formed.

16. Method according to claim 15, wherein a maximum of 15% of a surface of the combustion chamber is formed as a coolable wall portion.

17. Method according to claim 1, wherein the pulverized fuel-air mixture is supplied to the combustion area as a protective envelope.

18. Method according to claim 17, wherein the protective envelope is formed by nitrogen, which is supplied to the combustion area coaxially to the pulverized fuel-air mixture.

* * * * *